US006626497B2

(12) United States Patent
Nagamitsu et al.

(10) Patent No.: US 6,626,497 B2
(45) Date of Patent: Sep. 30, 2003

(54) BACKREST OF A CHAIR

(75) Inventors: Satoshi Nagamitsu, Higashiyamato (JP); Hiroshi Masunaga, Yokohama (JP)

(73) Assignee: Okamura Corporation (JP)

( * ) Notice: Subject to any disclaimer, the term of this patent is extended or adjusted under 35 U.S.C. 154(b) by 0 days.

(21) Appl. No.: 10/012,450

(22) Filed: Oct. 19, 2001

(65) Prior Publication Data

US 2002/0060492 A1 May 23, 2002

(30) Foreign Application Priority Data

Oct. 30, 2000 (JP) ..... 2000-330927

(51) Int. Cl.[7] ..... A47C 7/02

(52) U.S. Cl. ..... 297/452.15; 297/452.54; 297/452.56; 297/452.31; 297/452.36

(58) Field of Search ..... 297/452.15, 452.54, 297/452.56, 452.31, 452.36

(56) References Cited

U.S. PATENT DOCUMENTS

| | | | | | |
|---|---|---|---|---|---|
| 4,368,917 | A | * | 1/1983 | Urai | 297/452.54 |
| 4,418,958 | A | * | 12/1983 | Watkin | 297/452.15 |
| 4,529,247 | A | * | 7/1985 | Stumpf et al. | 297/300.4 |
| 4,856,846 | A | * | 8/1989 | Lohmeyer | 297/285 |
| 4,892,356 | A | * | 1/1990 | Pittman et al. | 297/452.15 |
| 5,934,758 | A | * | 8/1999 | Ritch et al. | 297/452.54 |
| 6,257,665 | B1 | * | 7/2001 | Nagamitsu et al. | 297/285 |

* cited by examiner

*Primary Examiner*—Peter M. Cuomo
*Assistant Examiner*—Sarah C. Burnham
(74) *Attorney, Agent, or Firm*—Skinner and Associates

(57) ABSTRACT

The backrest of a chair comprises an inner low rigidity flexible back-receiving portion and an outer high-rigidity side frame spaced from the back-receiving portion via a slit. The backrest is integrally molded by synthetic resin, thereby shortening manufacturing process and reducing its cost. Comfort of a sitting person is also attained.

6 Claims, 6 Drawing Sheets

BACKREST OF A CHAIR

BACKGROUND OF THE INVENTION

The present invention relates to the backrest of a chair in which a back-receiving portion is integrally molded with a frame.

In a conventional backrest of a chair, to the upper end of a metal back rod which extends from the lower portion of a seat upwards and rearwards, a back plate made of material different from that of the back rod is generally connected directly or indirectly via another material frame.

However, in the prior art, the back rod is made of material different from those of the frame and the back plate. Therefore, they are connected by screws, and there are disadvantages that it is impossible to shorten manufacturing processes and to decrease cost.

SUMMARY OF THE INVENTION

In view of the disadvantages in the prior art, it is an object of the present invention to provide the backrest of a chair in which a back plate is integrally molded with a frame which comprises at least part of a back rod, thereby shortening manufacturing processes, decreasing cost and providing comfort of a sitting person when one is reclined.

According to the present invention, there is provided the backrest of a chair, the backrest being an upright plate made of synthetic resin and comprising a low-rigidity flexible back-receiving portion for receiving the back of a sitting person, a pair of back rods, and pair of outer high-rigidity side frames each of which is spaced from said back-receiving portion via a slit, the lower end of each of said frames being connected to each of the back rods.

The backrest can be integrally formed from synthetic resin, thereby shortening manufacturing process and decreasing cost. The slits between the back-receiving portion and side frames provide sufficient flexibility and a comfortable chair.

BRIEF DESCRIPTION OF THE DRAWINGS

The features and advantages of the present invention will become more apparent from the following description with respect to embodiments as shown in appended drawings wherein.

DETAILED DESCRIPTION OF PREFERRED EMBODIMENTS

Figure 1:
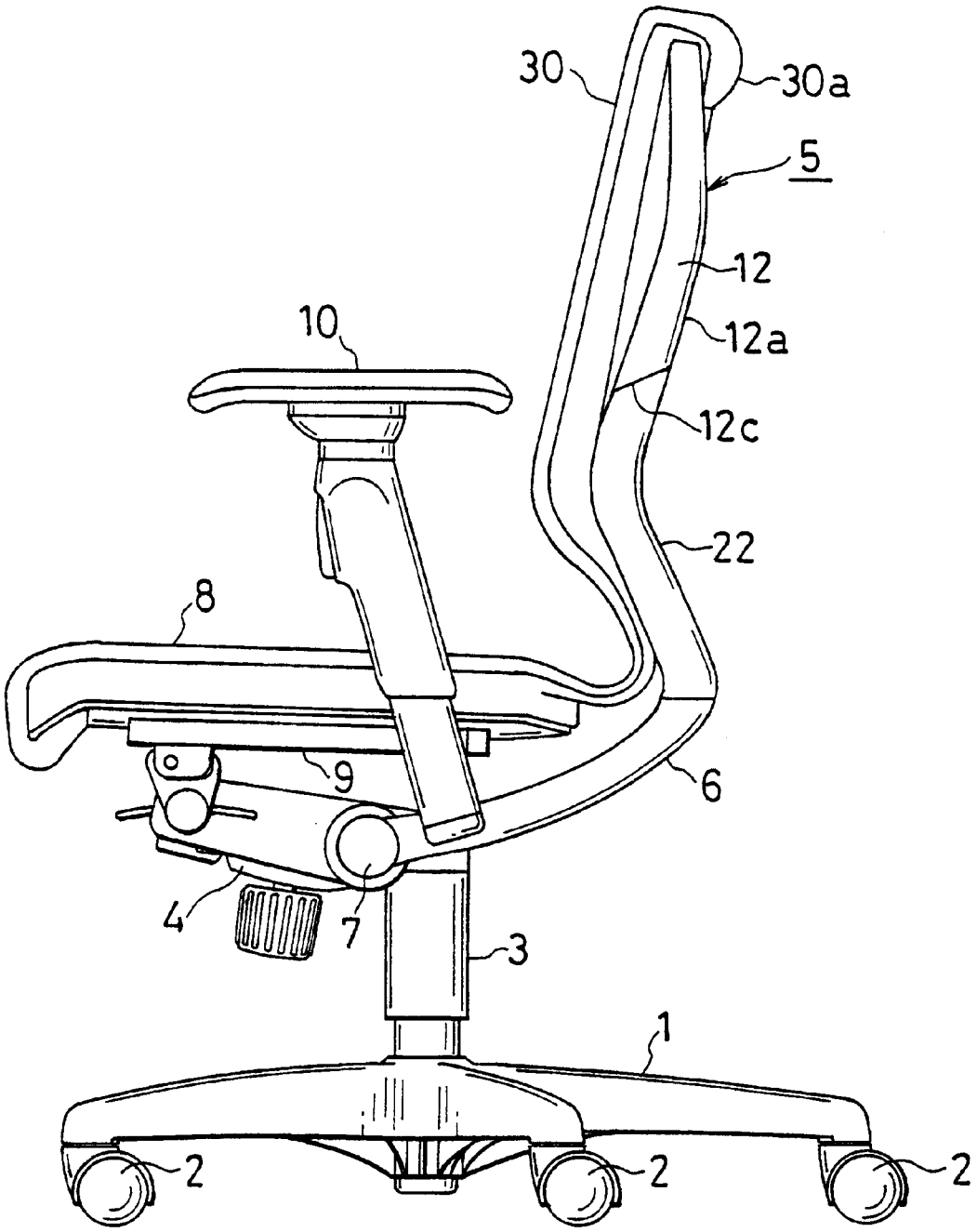
FIG. 1 is a side elevational view of a chair which includes one embodiment of the backrest according to the present invention.

As shown in FIG. 1, a caster 2 is secured at the end of a leg 1 which radially extends from the center. A support 3 is provided on the center of the leg 1, and is fixed to a base 4 at the upper end. A backrest 5 is supported by a pair of L-shaped back rods 6 which is pivoted on a base 4 by a horizontal shaft 7. The backrest 5 and back rods 6 can be inclined at a desired angle from a standing position in FIG. 1 rearwards by a spring-reclining mechanism (not shown) in the base 4.

Over the base 4, a seat 8 is supported via a seat support 9 to move down rearwards with inclination of the backrest 5 and the back rod 6. At each side of the seat support 9, an armrest 10 is mounted via a support rod 9*a*.

Figure 2:
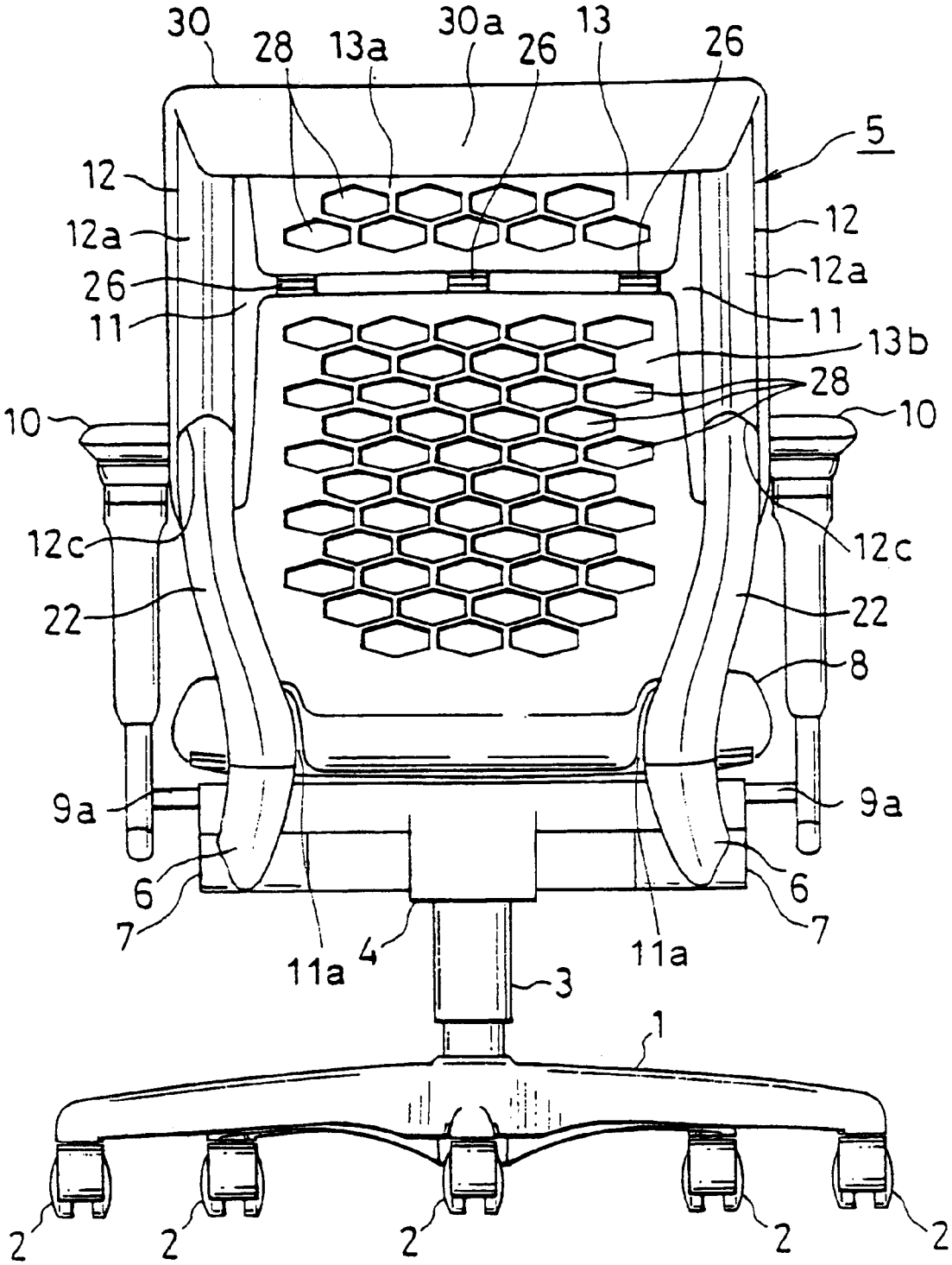
FIG. 2 is a rear elevational view of the same.
Figure 3:
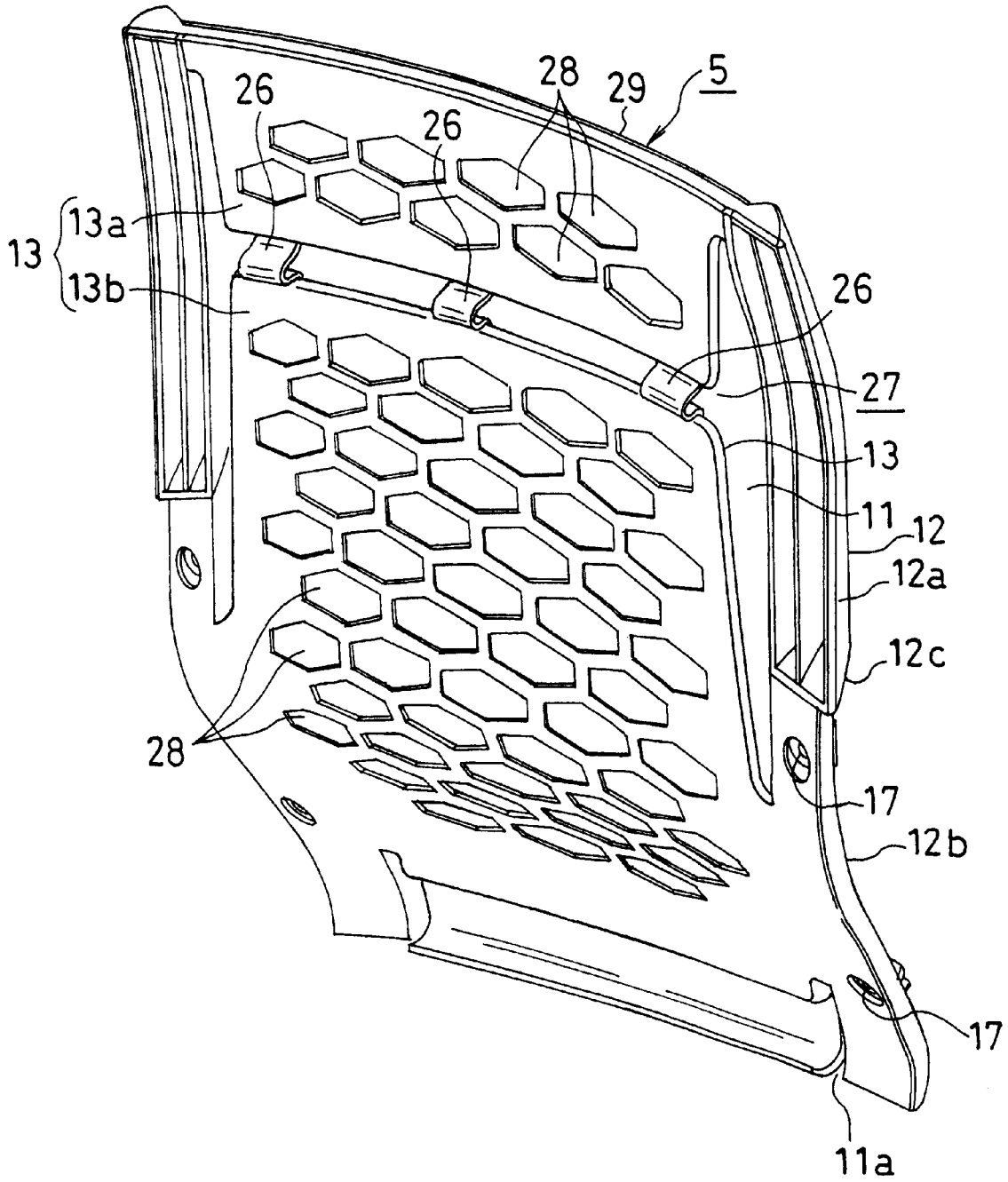
FIG. 3 is a front perspective view of a back plate.
Figure 4:
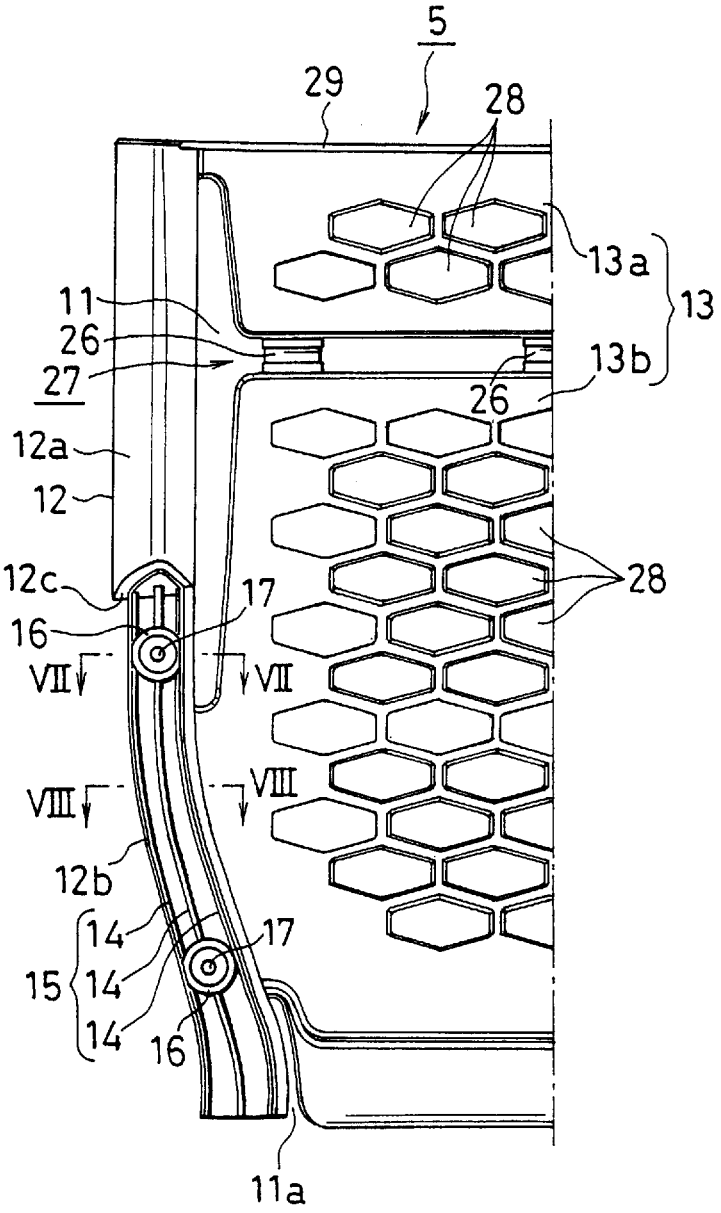
FIG. 4 is a left-half rear elevational view of the back plate.
Figure 5:
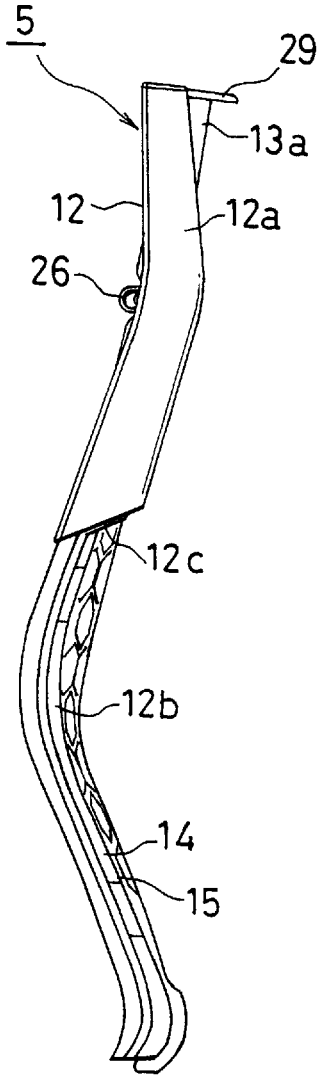
FIG. 5 is a side elevational view of the back plate.
Figure 6:
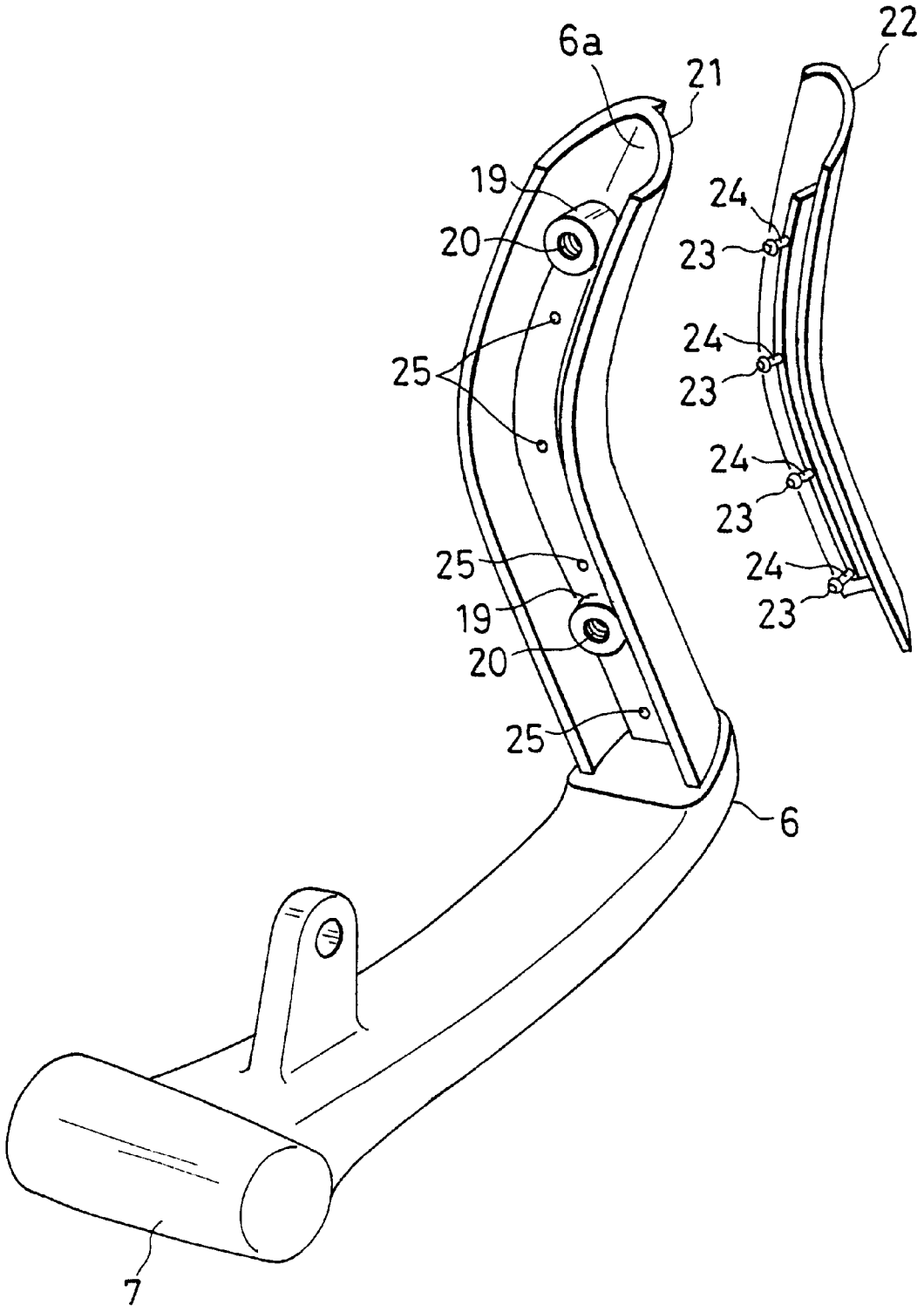
FIG. 6 is an exploded perspective view of a back rod and a cover.

As shown in FIG. 2, the backrest 5 is integrally molded from synthetic resin and has a rectangular shape near which vertical slits 11,11*a* are formed. Outside the slits 11,11*a*, a high-rigidity outer frame 12 is provided, and inside the slits 11,11*a*, a low-rigidity flexible back-receiving portion 13 is provided. The upper slit 11 is closed at both the upper and lower ends, while the lower slit 11*a* is closed at the upper end and opened at the lower end.

An upper portion 12*a* of the side frame 12 is formed like V-shape or an arc to increase thickness and rigidity. A lower portion 12*b* of the side frame is a flat front surface and a rear surface which has a plurality of vertical ribs 14 which form a projection 15. In this embodiment, the number of the rib 14 is three, and the middle rib is the longest.

Bosses 16 are provided on the rear surface of the lower portion 12*b*, and a through-bore 17 is formed at the center of each of the bosses 16.

Figure 7:
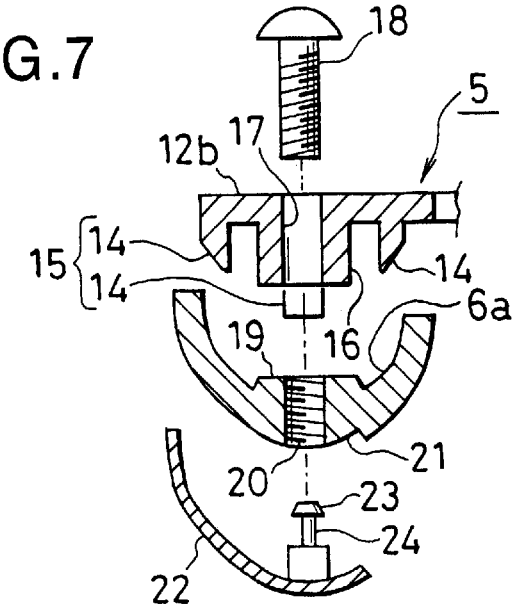
FIG. 7 is an exploded sectional plan view taken along the line VII—VII in FIG. 4.
Figure 8:
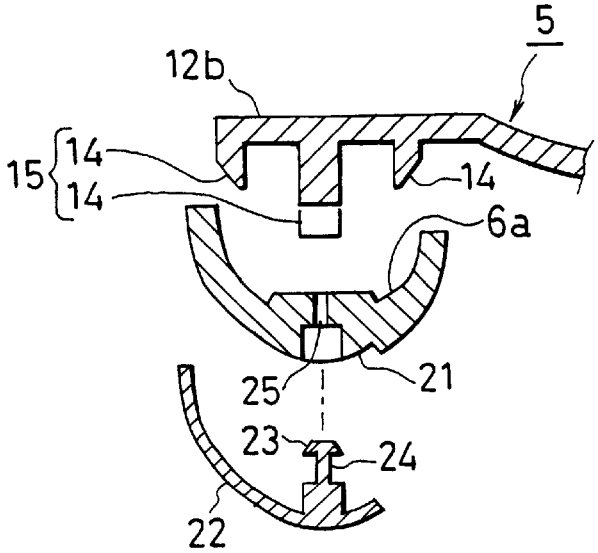
FIG. 8 is an exploded sectional plan view taken along the line VIII—VIII in FIG. 4.

The back rod 6 is made of metal such as Al alloy, and has a concave portion 6*a*. The concave portion 6*a* is engaged with a projection 15 of the lower portion 12*b* of the side frame 12. The upper end of the back rod 6 is engaged with a stepped portion 12*c* between the upper and lower portions 12*a* and 12*b*. As shown in FIG. 7, a screw 18 through a bore 17 is engaged in a bore 20 of a boss 19 at a position corresponding to the boss 16, thereby fastening the lower portion 12*b* of the side frame 12 to the upper portion of the back rod 6.

A low-stepped portion 21 is formed at the rear surface of the upper portion of the back rod 6. An elastic cover 22 made of synthetic resin or rubber is engaged with the low-stepped portion 21. The elastic cover 22 has the same shape as the upper portion 12*a* of the side frame 12 and substantially the same depth as that of the low-stepped portion 21. An engagement projection 24 which projects from the front surface of the cover 22 and having an elastically-deformable expanded-diameter portion 23 is engaged in a bore 25 of the back rod 6, so that the cover 22 is connected to the back rod 6.

By connection of the cover 22 to the back rod 6, the rear end of the bore 20 of the back rod 6 is covered to improve appearance.

The metal back rod 6 is protected, thereby preventing the back rod 6 from being damaged by a desk, a cabinet etc. The side frame 12 of the backrest 5 forms part or extension of the back rod 6, thereby acting as frame for supporting the sides of the backrest 5 strongly.

As shown in FIG. 2, the side frame 12 of the backrest 5, the back rod 6 and the cover 22 are integrally formed to provide S-shaped good appearance.

Thickness of the back-receiving portion 13 of the backrest 5 is smaller than that of the side frame 12, thereby providing flexibility to the back-receiving portion 13. The intermediate part of the back-receiving portion 13 is cut away to remain three flexible connectors 26 which form a bending portion 27.

By the bending portion 27, the back-receiving portion 13 is divided into upper and lower portions 13*a* and 13*b*. Thus, when a sitting person reclines against the back-receiving portion 13 strongly, especially in condition that the backrest 5 is inclined rearwards, the bending portion 27 moves rearwards of the other parts, and the upper and lower portions 13*a* and 13*b* are bent in V-shape. Therefore, even if the backrest 5 is inclined rearwards, the head of the person in a substantially upright position without making the head inclined rearwards, thereby providing comfortable posture to keep his eye to direct forwards.

Each of the flexible connectors 26 is projected forwards, so that the upper and lower portions 13*a* and 13*b* are easily bendable with respect to a crest of the flexible connector 26. If the connector 26 is projected rearwards, vertical tensile strength acts at the crest of the connector 26 to make the upper and lower portions difficult in bending. However, in this embodiment, the upper and lower portions 13*a*, 13*b* are likely to open.

In the upper and lower portions 13*a*,13*b* of the back-receiving portion 13, a number of hexagonal openings 28 are formed to increase flexibility of the upper and lower portions 13*a*,13*b*. Thinner portions may be formed instead of the openings.

A bending portion 29 projects rearwards at the upper end of the backrest 5 and increases rigidity of the upper end to act as an upper frame. The bending portion 29 holds the upper end of a cushion 30 and acts as a handle when the chair is moved.

The lower end of the lower portion 13*b* of the back-receiving portion 13 is spaced from the frame 12 by slits 11, and is connected to the rear end of the seat 8.

The cushion 30 covers the whole front surface of the backrest 5, and the bending portion 29 of the backrest 5 is covered with a winding portion 30*a* of the cushion 30.

Figure 9:
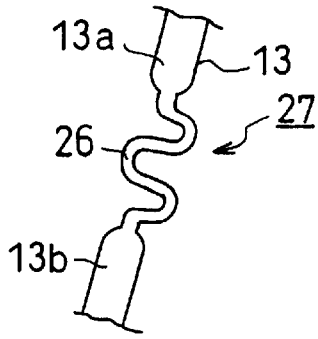
FIG. 9 is a side elevational view of a variation of a flexible connector.

The connector 26 may be formed like a wave as shown in FIG. 9. One connector 26 may be provided in the middle, and two connectors may be provided on both sides of the middle connector. More than three connectors may be provided at suitable distances.

The foregoing merely relates to embodiments of the present invention. Various modifications and variations may be made by person skilled in the art without departing from the scope of claims wherein:

What is claimed is:

1. A backrest of a chair, the backrest being an upright plate made of synthetic resin and comprising:

a low-rigidity flexible back-receiving portion for receiving a back of a sitting person;

a pair of back rods; and a pair of outer high-rigidity side frames each of which is spaced from said back-receiving portion via a slit, a lower end of each of said frames being connected to each of the back rods, said back receiving portion comprising upper and lower portions which are partially connected by a flexible connector, upper portions of said pair of outer high-rigidity side frames being gradually projected rearwards, an upper end of the back-receiving portion being inclined rearwards slightly of upper ends of the upper portions of the side frames.

2. The backrest as claimed in claim 1, integrally molded of synthetic resin.

3. The backrest as claimed in claim 1 wherein the side frame is thicker than the back-receiving portion.

4. The backrest as claimed in claim 1 wherein the back-receiving portion has a number of openings.

5. The backrest as claimed in claim 1 wherein the flexible connector projects forwards.

6. A flexible, reclinable backrest for a chair, the backrest being an upright plate made of synthetic resin, for maintaining eye alignment of user during reclining, comprising:

(a) a low-rigidity flexible back-receiving portion for receiving a back of a sitting person, said back receiving portion comprising a lower portion for supporting a lower portion of a users back and an upper portion for supporting the upper portion of a user's back, said upper and lower portions being flexibly partially connected by laterally aligned flexible connectors;

(b) a pair of vertically oriented back rods having an upper end; and (c) a pair of outer high-rigidity side frames each of which is spaced from said back-receiving portion via a slit, a lower end of each of said frames being connected to upper ends of each of the back rods, upper portions of said pair of outer high-rigidity side frames being gradually projected rearwards, an upper end of the back-receiving portion being inclined rearwards slightly of upper ends of the upper portions of the side frames.

* * * * *